US007553230B2

(12) United States Patent
Cannon

(10) Patent No.: US 7,553,230 B2
(45) Date of Patent: Jun. 30, 2009

(54) GAMING DEVICE HAVING MATCHING GAME WITH IMPROVED DISPLAY

(75) Inventor: Lee E. Cannon, Bozeman, MT (US)

(73) Assignee: IGT, Reno, NV (US)

( * ) Notice: Subject to any disclaimer, the term of this patent is extended or adjusted under 35 U.S.C. 154(b) by 432 days.

(21) Appl. No.: 10/953,430

(22) Filed: Sep. 28, 2004

(65) Prior Publication Data

US 2006/0068880 A1 Mar. 30, 2006

(51) Int. Cl.
*A63F 9/24* (2006.01)

(52) U.S. Cl. ..... 463/18; 463/16; 463/20; 273/138.1; 273/138.2; 273/139

(58) Field of Classification Search ..... 463/1, 463/10–13, 16–21, 23, 25–27, 29–34; 273/138.1, 273/148 R, 138.2, 139, 141 A, 142 B, 142 C, 273/142 J See application file for complete search history.

(56) References Cited

U.S. PATENT DOCUMENTS

| | | | |
|---|---|---|---|
| 1,527,929 | A | 2/1925 | Simons |
| 3,533,629 | A | 10/1970 | Raven et al. |
| 3,642,287 | A | 2/1972 | Lally et al. |
| 4,033,588 | A | 7/1977 | Watts |
| 4,157,829 | A | 6/1979 | Goldman et al. |
| 4,335,809 | A | 6/1982 | Wain |
| 4,339,798 | A | 7/1982 | Hedges et al. |
| 4,467,424 | A | 8/1984 | Hedges et al. |
| 4,494,197 | A | 1/1985 | Troy et al. |
| 4,508,357 | A | 4/1985 | Reich |
| 4,560,161 | A | 12/1985 | Hamano |
| 4,582,324 | A | 4/1986 | Koza et al. |
| 4,652,998 | A | 3/1987 | Koza et al. |
| 4,669,730 | A | 6/1987 | Small |
| 4,689,742 | A | 8/1987 | Troy et al. |
| 4,695,053 | A | 9/1987 | Vazquez et al. |
| 4,756,531 | A | 7/1988 | DiRe et al. |
| 4,775,155 | A | 10/1988 | Lees |
| 4,805,907 | A | 2/1989 | Hagiwara |
| 4,815,741 | A | 3/1989 | Small |
| 4,817,951 | A | 4/1989 | Crouch et al. |

(Continued)

FOREIGN PATENT DOCUMENTS

| | | |
|---|---|---|
| GB | 2201821 | 9/1988 |

(Continued)

OTHER PUBLICATIONS

Cleopatra Bingo Advertisement, written by IGT, published in 2000 and 2004.

(Continued)

*Primary Examiner*—Peter DungBa Vo
*Assistant Examiner*—Arthur O. Hall
(74) *Attorney, Agent, or Firm*—K&L Gates, LLP

(57) ABSTRACT

An improved number matching game is provided. The game includes a base matching game. A bonus game is played using randomly determined numbers from the base game that are compared to bonus numbers for a first bonus type and compared to bonus numbers for a second bonus type. An award may be provided depending on the outcome of the bonus comparisons. A display is provided to show the matches in a two dimensional or grid arrangement.

31 Claims, 7 Drawing Sheets

U.S. PATENT DOCUMENTS

| | | | | |
|---|---|---|---|---|
| 4,836,546 | A | 6/1989 | DiRe | |
| 4,836,548 | A | 6/1989 | Chittenden | |
| 4,842,278 | A | 6/1989 | Markowicz | |
| 4,856,787 | A | 8/1989 | Itkis | |
| 4,982,337 | A | 1/1991 | Burr et al. | |
| 5,042,809 | A | 8/1991 | Richardson | |
| 5,046,737 | A | 9/1991 | Fienberg | |
| 5,092,598 | A | 3/1992 | Kamille | |
| 5,100,139 | A | 3/1992 | Di Bella | |
| 5,116,049 | A | 5/1992 | Sludikoff et al. | |
| 5,158,293 | A | 10/1992 | Mullins | |
| 5,242,163 | A | 9/1993 | Fulton | |
| 5,265,874 | A | 11/1993 | Dickinson et al. | |
| 5,276,312 | A | 1/1994 | McCarthy | |
| 5,282,620 | A | 2/1994 | Keesee | |
| 5,324,035 | A | 6/1994 | Morris et al. | |
| 5,324,041 | A | 6/1994 | Boylan et al. | |
| 5,380,007 | A * | 1/1995 | Travis et al. | 463/18 |
| 5,398,932 | A | 3/1995 | Eberhardt et al. | |
| 5,401,024 | A * | 3/1995 | Simunek | 463/18 |
| 5,407,199 | A | 4/1995 | Gumina | |
| 5,584,764 | A | 12/1996 | Inoue | |
| 5,586,937 | A | 12/1996 | Menashe | |
| 5,609,524 | A | 3/1997 | Inoue | |
| 5,628,684 | A | 5/1997 | Bouedec | |
| 5,639,089 | A | 6/1997 | Matsumoto et al. | |
| 5,647,798 | A * | 7/1997 | Falciglia | 463/19 |
| 5,674,128 | A | 10/1997 | Holch et al. | |
| 5,718,631 | A | 2/1998 | Invencion | |
| 5,722,891 | A | 3/1998 | Inoue | |
| 5,755,619 | A | 5/1998 | Matsumoto et al. | |
| 5,779,545 | A | 7/1998 | Berg et al. | |
| 5,800,269 | A | 9/1998 | Holch et al. | |
| 5,871,398 | A | 2/1999 | Schneier et al. | |
| 5,909,875 | A * | 6/1999 | Weingardt | 273/269 |
| 5,919,091 | A | 7/1999 | Bell et al. | |
| 5,927,714 | A | 7/1999 | Kaplan | |
| 5,935,002 | A | 8/1999 | Falciglia | |
| 5,944,606 | A | 8/1999 | Gerow | |
| 5,947,821 | A * | 9/1999 | Stone | 463/13 |
| 5,949,042 | A | 9/1999 | Dietz, II et al. | |
| 5,954,582 | A | 9/1999 | Zach | |
| 5,970,143 | A | 10/1999 | Schneier et al. | |
| 5,971,849 | A | 10/1999 | Falciglia | |
| 5,988,643 | A | 11/1999 | Awada | |
| 5,989,121 | A | 11/1999 | Sakamoto | |
| 5,996,997 | A | 12/1999 | Kamille | |
| 5,997,401 | A | 12/1999 | Crawford | |
| 6,015,346 | A * | 1/2000 | Bennett | 463/20 |
| 6,017,032 | A | 1/2000 | Grippo et al. | |
| 6,024,640 | A | 2/2000 | Walker et al. | |
| 6,033,306 | A * | 3/2000 | De Souza | 463/18 |
| 6,033,307 | A | 3/2000 | Vancura | |
| 6,079,711 | A | 6/2000 | Wei et al. | |
| 6,089,976 | A | 7/2000 | Schneider et al. | |
| 6,089,982 | A | 7/2000 | Holch et al. | |
| 6,099,408 | A | 8/2000 | Schneir et al. | |
| 6,102,400 | A | 8/2000 | Scott et al. | |
| 6,102,798 | A | 8/2000 | Bennett | |
| 6,105,962 | A | 8/2000 | Malavazos et al. | |
| 6,117,009 | A * | 9/2000 | Yoseloff | 463/20 |
| 6,126,542 | A | 10/2000 | Fier | |
| 6,129,355 | A | 10/2000 | Hahn et al. | |
| 6,129,632 | A | 10/2000 | Luciano | |
| 6,135,882 | A | 10/2000 | Kadlic | |
| 6,135,885 | A | 10/2000 | Lermusiaux | |
| 6,146,271 | A | 11/2000 | Kadlic | |
| 6,146,272 | A | 11/2000 | Walker et al. | |
| 6,149,156 | A | 11/2000 | Feola | |
| 6,149,157 | A | 11/2000 | Suan | |
| 6,159,097 | A | 12/2000 | Gura | |
| 6,159,098 | A | 12/2000 | Slomiany et al. | |
| 6,164,652 | A | 12/2000 | Lauretta et al. | |
| 6,168,521 | B1 | 1/2001 | Luciano et al. | |
| 6,174,235 | B1 | 1/2001 | Walker et al. | |
| 6,183,361 | B1 | 2/2001 | Cummings et al. | |
| 6,190,254 | B1 | 2/2001 | Bennett | |
| 6,190,255 | B1 | 2/2001 | Thomas et al. | |
| 6,203,428 | B1 | 3/2001 | Giobbi et al. | |
| 6,210,275 | B1 | 4/2001 | Olsen | |
| 6,210,276 | B1 | 4/2001 | Mullins | |
| 6,210,279 | B1 | 4/2001 | Dickinson | |
| 6,217,448 | B1 | 4/2001 | Olsen | |
| 6,220,961 | B1 | 4/2001 | Keane et al. | |
| 6,227,969 | B1 | 5/2001 | Yoseloff | |
| 6,227,971 | B1 | 5/2001 | Weiss | |
| 6,231,442 | B1 | 5/2001 | Mayeroff | |
| 6,234,897 | B1 | 5/2001 | Frohm et al. | |
| 6,241,606 | B1 | 6/2001 | Riendeau et al. | |
| 6,250,685 | B1 | 6/2001 | Walker et al. | |
| 6,254,480 | B1 | 7/2001 | Zach | |
| 6,261,177 | B1 | 7/2001 | Bennett | |
| 6,273,820 | B1 | 8/2001 | Haste, III | |
| 6,280,328 | B1 | 8/2001 | Holch et al. | |
| 6,283,855 | B1 | 9/2001 | Bingham | |
| 6,309,298 | B1 | 10/2001 | Gerow | |
| 6,309,299 | B1 | 10/2001 | Weiss | |
| 6,312,334 | B1 | 11/2001 | Yoseloff | |
| 6,315,291 | B1 | 11/2001 | Moody | |
| 6,315,664 | B1 | 11/2001 | Baerlocher et al. | |
| 6,319,124 | B1 | 11/2001 | Baerlocher et al. | |
| 6,325,716 | B1 | 12/2001 | Walker et al. | |
| 6,331,143 | B1 * | 12/2001 | Yoseloff | 463/18 |
| 6,336,860 | B1 | 1/2002 | Webb | |
| 6,336,862 | B1 | 1/2002 | Byrne | |
| 6,346,043 | B1 | 2/2002 | Colin et al. | |
| 6,347,996 | B1 | 2/2002 | Gilmore et al. | |
| 6,358,151 | B1 | 3/2002 | Enzminger et al. | |
| 6,364,313 | B1 | 4/2002 | Moody | |
| 6,364,766 | B1 | 4/2002 | Anderson et al. | |
| 6,364,767 | B1 | 4/2002 | Brossard et al. | |
| 6,368,214 | B1 | 4/2002 | Luciano | |
| 6,368,218 | B2 | 4/2002 | Angell, Jr. | |
| 6,398,644 | B1 | 6/2002 | Perrie et al. | |
| 6,398,645 | B1 | 6/2002 | Yoseloff | |
| 6,402,614 | B1 | 6/2002 | Schneier et al. | |
| 6,406,369 | B1 | 6/2002 | Baerlocher et al. | |
| 6,413,160 | B1 | 7/2002 | Vancura | |
| 6,419,583 | B1 | 7/2002 | Crumby et al. | |
| 6,425,823 | B1 | 7/2002 | Byrne | |
| 6,443,456 | B1 * | 9/2002 | Gajor | 273/303 |
| 6,443,837 | B1 | 9/2002 | Jaffe et al. | |
| 6,450,885 | B2 | 9/2002 | Schneier et al. | |
| 6,454,648 | B1 | 9/2002 | Kelly et al. | |
| RE37,885 | E | 10/2002 | Acres et al. | |
| 6,464,582 | B1 | 10/2002 | Baerlocher et al. | |
| 6,471,587 | B1 * | 10/2002 | Wood et al. | 463/13 |
| 6,475,086 | B2 | 11/2002 | Zach | |
| 6,478,677 | B1 | 11/2002 | Moody | |
| 6,485,367 | B1 | 11/2002 | Joshi | |
| 6,506,117 | B2 | 1/2003 | DeMar et al. | |
| 6,508,711 | B1 | 1/2003 | Ono | |
| 6,514,144 | B2 | 2/2003 | Riendeau et al. | |
| 6,524,184 | B1 | 2/2003 | Lind et al. | |
| 6,527,638 | B1 | 3/2003 | Walker et al. | |
| 6,533,660 | B2 | 3/2003 | Seelig et al. | |
| 6,533,664 | B1 | 3/2003 | Crumby | |
| 6,537,150 | B1 | 3/2003 | Luciano et al. | |
| 6,561,512 | B2 | 5/2003 | Luciano et al. | |
| 6,605,000 | B2 | 8/2003 | Adams | |
| 6,626,757 | B2 | 9/2003 | Oliveras | |
| 6,645,071 | B2 | 11/2003 | Perrie et al. | |
| 6,648,758 | B2 * | 11/2003 | Bennett et al. | 463/20 |
| 6,656,044 | B1 | 12/2003 | Lewis | |

| | | | | |
|---|---|---|---|---|
| 6,663,488 | B1 | 12/2003 | Adams | |
| 6,702,699 | B2 | 3/2004 | Touhey et al. | |
| 6,705,944 | B2 | 3/2004 | Luciano | |
| 6,729,961 | B1 | 5/2004 | Millerschone | |
| 6,733,386 | B2 | 5/2004 | Cuddy et al. | |
| 6,739,970 | B2 | 5/2004 | Luciano | |
| 6,749,500 | B1 | 6/2004 | Nelson et al. | |
| 6,749,502 | B2 * | 6/2004 | Baerlocher | 463/16 |
| 6,764,397 | B1 | 7/2004 | Robb | |
| 6,824,465 | B2 | 11/2004 | Luciano, Jr. | |
| 6,855,055 | B2 | 2/2005 | Perrie et al. | |
| 6,921,334 | B1 | 7/2005 | Bennett | |
| 7,040,984 | B2 * | 5/2006 | Mead | 463/16 |
| 7,066,814 | B2 * | 6/2006 | Glavich et al. | 463/20 |
| 7,128,645 | B1 * | 10/2006 | White et al. | 463/13 |
| 7,316,607 | B2 * | 1/2008 | Gauselmann | 463/13 |
| 7,316,608 | B2 * | 1/2008 | Moody | 463/16 |
| 7,329,183 | B2 * | 2/2008 | Michaelson et al. | 463/21 |
| 7,413,511 | B2 * | 8/2008 | Seelig et al. | 463/22 |
| 2002/0010013 | A1 | 1/2002 | Walker et al. | |
| 2002/0058545 | A1 | 5/2002 | Luciano | |
| 2002/0072404 | A1 | 6/2002 | Gerow | |
| 2002/0082070 | A1 | 6/2002 | Macke et al. | |
| 2002/0098882 | A1 | 7/2002 | Lind et al. | |
| 2002/0098883 | A1 | 7/2002 | Packes, Jr. et al. | |
| 2002/0111214 | A1 | 8/2002 | Lind et al. | |
| 2002/0113369 | A1 | 8/2002 | Weingardt | |
| 2002/0137559 | A1 | 9/2002 | Baerlocher | |
| 2002/0169018 | A1 | 11/2002 | Schneier et al. | |
| 2003/0036420 | A1 | 2/2003 | Baerlocher et al. | |
| 2003/0045338 | A1 | 3/2003 | Dolloff et al. | |
| 2003/0064773 | A1 | 4/2003 | Baerlocher et al. | |
| 2003/0144050 | A1 * | 7/2003 | Keaton et al. | 463/19 |
| 2003/0153379 | A1 * | 8/2003 | Beaulieu | 463/16 |
| 2003/0181234 | A1 | 9/2003 | Falciglia, Sr. | |
| 2003/0193136 | A1 | 10/2003 | Walker et al. | |
| 2004/0023708 | A1 | 2/2004 | Kaminkow et al. | |
| 2004/0043812 | A1 * | 3/2004 | Ellis | 463/20 |
| 2004/0106445 | A1 * | 6/2004 | Perrie et al. | 463/16 |
| 2004/0152510 | A1 * | 8/2004 | Herrmann et al. | 463/25 |
| 2005/0014553 | A1 | 1/2005 | Byrne | |
| 2005/0054405 | A1 * | 3/2005 | Baerlocher et al. | 463/9 |
| 2005/0130737 | A1 * | 6/2005 | Englman et al. | 463/25 |
| 2005/0202863 | A1 * | 9/2005 | Macaulay | 463/13 |
| 2005/0227753 | A1 | 10/2005 | Luciano, Jr. | |
| 2006/0030401 | A1 * | 2/2006 | Mead et al. | 463/22 |
| 2006/0183531 | A1 * | 8/2006 | Thomas | 463/18 |
| 2007/0004505 | A1 * | 1/2007 | Walker et al. | 463/26 |

FOREIGN PATENT DOCUMENTS

| | | | |
|---|---|---|---|
| GB | 2 374 294 | A | 10/2002 |
| WO | WO 02/097749 | A2 | 12/2002 |
| WO | WO 2004/014502 | A2 | 2/2004 |

OTHER PUBLICATIONS

Slingo Games, written by Slingo.com Slingo Games (website: www.slingo.com/games/online/game.php), printed on Apr. 25, 2003.
Cash Keno Paytable, written by IGT, available prior to 2003.
Triple Diamond Keno Paytable, written by IGT, available prior to 2003.
Alley Cat Keno Game Description, written by IGT, available prior to Sep. 28, 2004.
Big Top Keno Advertisement, written by Aristocrat, published Oct. 2000.
Bingo Advertisement, written by Casino Data Systems, published 1998.
Bingo Advertisement, written by WMS Gaming, Inc., published prior to 2003.
Bing Ball Bingo Advertisement, written by BCSI Corporation, published prior to 2003.
Bingo Brasil Advertisement, written by Unidesa Gaming, published prior to 2003.
Bingo Game Station Advertisement, written by Cole Gaming Technologies, published prior to 2003.
Bingo Party Advertisement, written by Amatic Industries, published 2001.
Bingo Slot Advertisement, written by Unidesa Gaming, published prior to 2003.
Bingo Slots Advertisement, written by Odds on Gaming, published prior to 2003.
Bingo Wizard Advertisement, written by Applied Concepts, published 2002.
Bonus Bingo Advertisement, written by Unidesa Gaming, published prior to 2003.
California Dreams Advertisement, written by Cadillac Jack, published prior to 2003.
Canadian Bingo Advertisement, written by Unidesa Gaming, published prior to 2003.
Diamonopoly Advertisement, written by International Gamco, Inc., published 2002.
Dual Screen Keno Machine Picture Advertisement, written by Acres Gaming, Inc., published prior to 2003.
Electronic Pull Tabs Advertisement, written by 21st Century Gaming, published prior to 2002.
Free Game Keno, written by Keno-Info.com (website: www.keno-info.com/free_keno_game.html), website published 2002, printed on Aug. 11, 2002.
Five Card Instant Bingo Advertisement, written by IGT, published 2000.
Flamingo Reno-Keno, published prior to 2003.
Four Card Keno Game Screen Advertisement, written by IGT, published prior to 2001.
Gold Touch Multi-Game Advertisement, written by Cadillac Jack, published prior to 2003.
Instant Bingo Video Slots Advertisement, written by IGT, published 2002.
Instant Winner Advertisement, written by Williams/WMS Gaming, published prior to 2002.
Keno Advertisement, written by Cyberdyne Gaming, published prior to 2003.
Keno Advertisement, written by Odds on Gaming, published prior to 2003.
Keno Advertisement, written by WMS Gaming, Inc., published prior to 2003.
Krazy Keno Advertisement, written by Silicon Gaming, published prior to 2001.
Lucky Times California Lottery Newsletter, published 1996.
Party Time Bingo Advertisement, written by Astra Games Limited, published prior to 2003.
Play it Again Advertisement, written by International Gamco, Inc., published 2000.
Pot O' Gold Advertisement, written by Vision Gaming & Technology, published prior to 2003.
Reel Bingo Advertisement, written by B Soft, published prior to 2003.
Southern Gold Advertisement, written by Cadillac Jack, published prior to 2003.
Star Spangled Keno, Advertisement, written by Silicon Gaming, published 2001.
Ultimate Keno Advertisement, written by Bally Gaming Systems, published 2000.
Battleship Advertisement (website) written by www.mikohn.com, printed Apr. 25, 2001.
Battleship Article written by Strictly Slots, published in 2000.
Fortune Cookie Advertisement (website) written by www.igt.com, printed Mar. 21, 2001.
Fortune Cookie Advertisement written by IGT, published in 2000.
Ghost Hunter Advertisement written by Atronic, published in 2003.
Magic 8 Ball Advertisement written by IGT, published in 2003.
One page sheet showing and describing a 1977 Bally Monte Carlo game.
Slot City "Anchor Games Unveils City of Slots," written by Anchor Games, published in 2001.
Slot Machines, A Pictorial History of the First 100 Years, 5th ed., written by Marshall Fey, published in 1983, p. 17.

Slot Toppers Article written by Strictly Slots, published in 2000.
Slots 2003, written by Melissa Raimondi, published in Jan. 2003.
The Price is Right brochure written by IGT, published in 2001.
Wheel & Deal Brochure written by Anchor Games, Strictly Slots, published in Dec. 2001.
Wheel of Fortune Advertisement written by IGT, 1999.
Wheel of Fortune Game Machine description by IGT, 1998.
Wheel of Fortune Video Slots Advertisement written by IGT, published in 2002.
Wheel Poker Brochure written by Anchor Games/Bally Gaming, Strictly Slots, available Sep. 2002.

* cited by examiner

FIG. 6

70

DISPLAY SEQUENCES

72 Bonus sequences displayed on separate display device and substantially simultaneously with base game sequence display 74 Bonus sequences displayed on separate display device after base game sequence display 76 Bonus sequences displayed on same display device substantially simultaneously with base game sequence display 78 Bonus sequences displayed on same display device after base game sequence display 80 Bonus sequences displayed regardless of base game outcome 82 Bonus sequences displayed only upon win in base game or upon threshold amount of base game matches

FIG. 7

90

BONUS PICKS

92 Same as player's picks in base game, same picks used for both bonus award types 94 Same as player's picks in base game, player's picks split among both bonus award types 96 Player picks separately for bonus game and for both bonus award types 98 Player's base game picks used for one bonus award type, player picks separately for other bonus award types 100 Bonus numbers made randomly by game for both bonus award types 102 Player's pick some bonus numbers, game randomly generates other bonus numbers, both bonus numbers distributed as desired to different bonus award types 104 Bonus numbers for both bonus award types fixed for (i) all time (ii) for a number of game plays (iii) for a period of time (iv) until player switches (v) until operator switches 106 Player's pick some bonus numbers, other bonus numbers fixed, both bonus numbers distributed as desired to different bonus award types 108 Game randomly picks some bonus numbers, other bonus numbers fixed, both bonus numbers distributed as desired to different bonus award types

FIG. 8

110

BONUS AWARD TYPES

112 Interactive
114 Non-Interactive
116 Free Games
118 Multiplier
120 Credit Value
122 Hand Pay
124 Ticket Pay
126 Non-Monetary

GAMING DEVICE HAVING MATCHING GAME WITH IMPROVED DISPLAY

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

CROSS REFERENCE TO RELATED APPLICATIONS

This application relates to the following, commonly owned applications: "GAMING DEVICE HAVING FREE GAME KENO," Ser. No. 10/243,051, now U.S. Pat. No. 7,306,519, "GAMING DEVICE HAVING GAME WITH SEQUENTIAL DISPLAY OF NUMBERS," Ser. No. 10/639,715, "CENTRAL DETERMINATION SYSTEM WITH A KENO GAME," Ser. No. 10/601,482, "GAMING DEVICE HAVING A WAGERING GAME WHEREIN A WAGER AMOUNT IS AUTOMATICALLY DETERMINED BASED ON A QUANTITY OF PLAYER SELECTIONS," Ser. No. 11/011,810, "GAMING DEVICE HAVING A MASKED AWARD GAME," Ser. No. 10/210,540, now U.S. Pat. No. 7,300,348, "GAMING DEVICE HAVING AN OFFER AND ACCEPTANCE GAME," Ser. No. 11/122,719, and "GAMING DEVICE HAVING MATCH GAME WITH AWARD DETERMINED BY PREDICTION OF CORRECT MATCHES," Ser. No. 10/651,371, now U.S. Pat. No. 7,341,513.

BACKGROUND OF THE INVENTION

The present invention relates to wagering gaming devices. More particularly, the present invention relates to variations to Keno, Lotto and Bingo games for wagering gaming machines.

Although the present invention is applicable to Keno, Lotto and Bingo, for ease of illustration, the invention is described mainly in connection with Keno and in particular gaming devices such as Video Keno games.

Early versions of American Keno used characters on the Keno ticket, rather than the numbers used today. The American game dropped the number of characters to the more familiar eighty. When gambling was legalized Nevada in 1931, the "Chinese lottery" game was referred to instead as "Horse Race Keno", capturing the idea that the numbers are horses and the player wants the wagered horse to win, place or show. Over time the name has been shortened to simply "Keno".

Keno is similar to a lottery game. The goal is to choose a winning number or numbers from a plurality of numbers. Most current versions of Keno have eighty numbers including the numbers one to eighty. The player can bet on any number or numbers, up to fifteen numbers, which the player does by marking or picking the selected numbers.

In older Keno games the numbers were generated using ping-pong type balls. In more modern Keno, numbers are generated via computers using random number generators. When a number is chosen, the number is shown electronically on Keno boards throughout the casino or on a video monitor of a Keno gaming device.

In live Keno, a number of Keno outlets and Keno monitors are placed in various places around a casino or gaming establishment. The player plays using a ticket and returns a winning ticket to the Keno ticket writer to redeem the win. In video Keno, the game keeps track of wins and losses via a credit display as with other types of wagering gaming machines.

Certain variations of Keno have expected returns that are dependent on a number of factors. In general, the highest award for matching all picked numbers increases as the amount of numbers the player plays increases. The frequency of winning depends for example on how few matches are needed to obtain any award. The gaming device manufacturers create a paytable for varying amounts of matches to produce a desired expected value.

Keno has been embodied in various types of gaming devices. While Keno is relatively popular in video format, a need exists to provide variations of Keno to players to make the play of both the video and casino versions of Keno more enjoyable, fun and exciting. Bonusing is one known way to increase the fun and excitement of video gaming. A need therefore exists for new bonus games operable with the game of Keno.

SUMMARY OF THE INVENTION

The present invention provides improved number matching games, such as Keno, Lotto and Bingo, which can be employed in both a gaming device and also in live gaming at a casino.

One embodiment of the present invention includes a bonus game that is played in association with a base matching game, such as Keno, Bingo and Lotto. In each of the base games, the player picks a first set of symbols such as numbers from a pool of numbers. The gaming device independently and in one embodiment randomly generates a second set of symbols such as numbers from the pool of numbers. The player is provided an award, if any, based on how many of the numbers from the first set and second set match.

The bonus game includes in one embodiment two different award types. Each award type is based on a comparison between a set of bonus numbers and the randomly generated gaming device numbers from the base game. The bonus numbers can be the same or different for each bonus award type. In one preferred embodiment, the bonus numbers are generated from the numbers remaining from the pool that have not been picked by the player in the bonus game. The bonus numbers can alternatively be player picked. The numbers used to compare against the bonus numbers are alternatively different than the base game numbers.

One embodiment of the present invention includes an interactive display that shows a two dimensional visual movement or indication of how many matches occur between the bonus numbers for the first bonus award type and the base game numbers for the first bonus award type and the bonus numbers for the second bonus award type and the base game numbers for the second bonus award type. In a further alternative embodiment, a third set of bonus numbers are provided and compared with the base game numbers. The interactive display can then be made in three dimensions on a video monitor.

In one illustrative embodiment of the present invention, the interactive display shows a skier moving downhill in two directions. One direction corresponds to the first bonus award type. The second direction corresponds to the second bonus award type. Thus, if the player achieves three matches for the first bonus type and two matches for the second bonus type, the display device shows a skier moving three units, places, levels or ranks in the first direction and two units, places, levels or ranks in a second direction. The overall movement is a three unit by two unit, two-dimensional movement. The skier can arrive at the three by two final position using any combination of paths leading to such position. Any suitable audio, visual or audiovisual display can be used to represent the movement or indication of the number of matches for the first and second bonus types.

The bonus award types can be any suitable type of bonus award, such as a number of game credits, a multiplier, a number of free games, a non-monetary award, etc. In one embodiment, the bonus types interact, that is, one bonus type is dependent upon the other. For example, one bonus type can be a multiplier that is provided in connection with a second bonus type such as a free game. If the player does not obtain a free game, the player does not benefit from the generation of a bonus multiplier. It should be appreciated, however, that the multiple bonus types do not have to be interactive and can instead operate independently of one another.

The present invention includes multiple embodiments for timing the sequence of the differing displays, namely, the base game display and the bonus game display. In general, the base and bonus displays can be simultaneous, substantially simultaneous or sequential. The base and bonus displays can also be provided on the same monitor or on different display devices.

The present invention also contemplates multiple embodiments for determining the bonus numbers used in the bonus game evaluations. The bonus picks in one embodiment are fixed. In another embodiment, the gaming device independently and randomly generates picks for one or more of the bonus games. In a further embodiment, the player picks new picks for one or more of the bonus games. Still further, the gaming device employs a combination of the various methods for selecting the bonus picks.

It should thus be appreciated that each set of numbers can be generated independently, or alternatively partially independently, partially dependently, or dependently with respect to a base game generation of numbers.

It is therefore an advantage of the present invention to provide an improved matching type game.

It is another advantage of the present invention to provide a gaming device having a fun and interesting display.

Moreover, it is an advantage of the present invention to provide a bonus matching game that interacts with a base matching game.

It is also an advantage of the present invention to provide fun and exciting Keno, Bingo and Lotto displays.

Another advantage of the present invention is more fun and exciting Keno, Bingo and Lotto games.

Yet a further advantage of the present invention is to provide a more entertaining presentation of a sequential display of whether or not a player's picks result in award winning matches.

Still a further advantage of the present invention is to add flexibility to the display of Keno, Bingo and Lotto type games.

A further advantage of the present invention is to provide Keno, Bingo and Lotto games having bonusing.

Still further, an advantage of the present invention is to provide fun and exciting Keno, Bingo and Lotto games that may be implemented in a gaming device or via a table game.

Additional features and advantages of the present invention are described in, and will be apparent from, the following Detailed Description of the Invention and the figures.

BRIEF DESCRIPTION OF THE FIGURES

FIG. 6 is a table highlighting some of the alternative display sequences for the base and bonus games of the present invention.

FIG. 7 is a table highlighting some of the different ways in which the bonus numbers for the bonus game(s) of the present invention can be made.

FIG. 8 is a table highlighting some of the different types of bonus awards that may be implemented in the bonus game of the present invention.

DETAILED DESCRIPTION OF THE INVENTION

Figure 1:
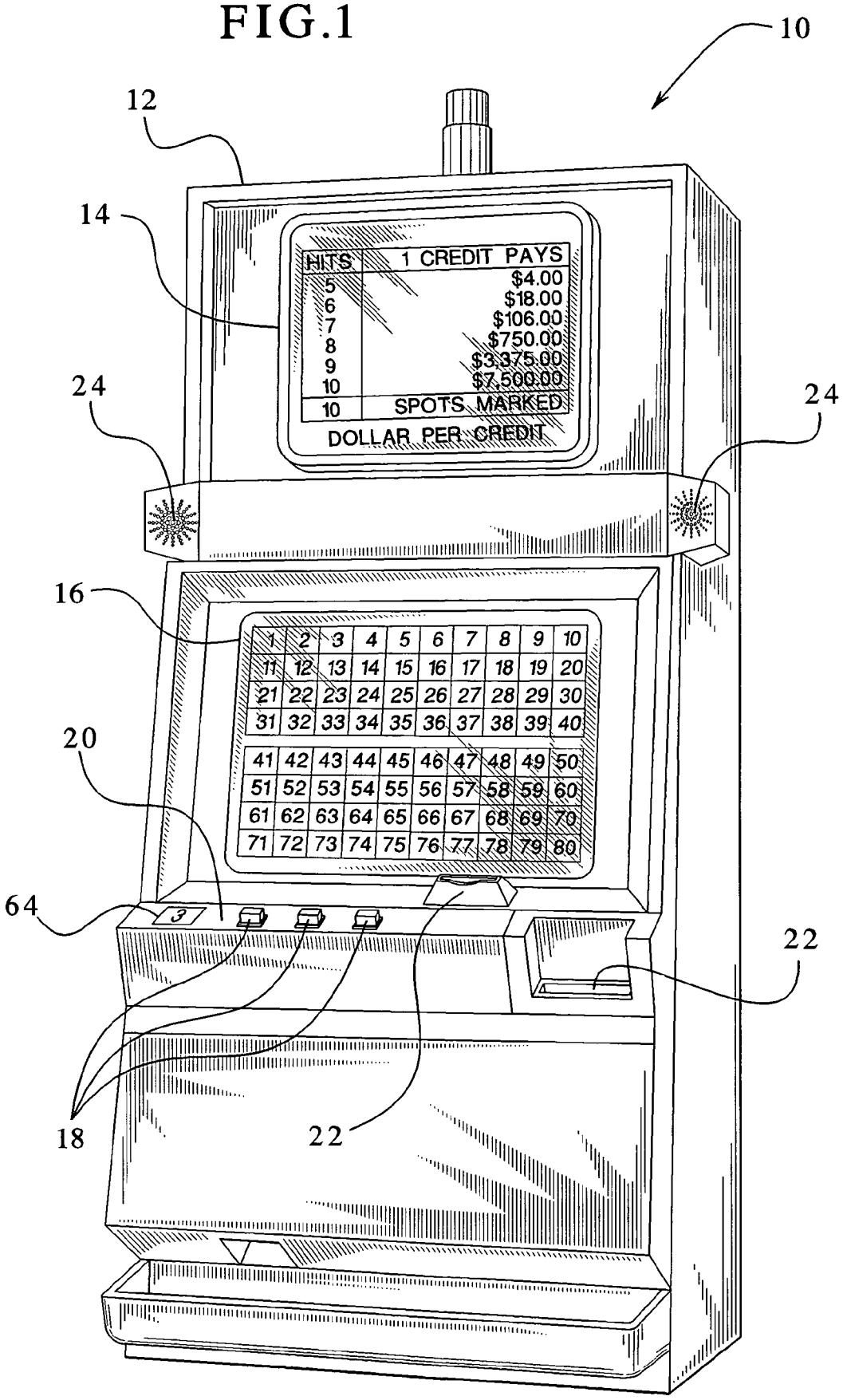
FIG. 1 is a perspective view of a gaming device incorporating the Keno, Lotto or Bingo game of the present invention.

Referring now to FIG. 1, each of the embodiments described herein is provided in one preferred embodiment in a gaming device 10. Alternatively, certain embodiments are provided on various monitors throughout a casino or gaming establishment. Gaming device 10 is in one embodiment a video gaming device and includes a cabinet 12 having at least one video monitor. The illustrated embodiment includes two video monitors 14 and 16. Cabinet 12 is illustrated as being of a type where the player stands or sits. The cabinet is alternatively a bar top cabinet, wherein the player sits to play the Keno, Lotto or Bingo game of the present invention. While the present invention is applicable to any wagering game that displays numbers sequentially to show whether or how much the player wins, such as Keno, Bingo and Lotto, the description of the gaming device 10, for simplicity, is mainly described in connection with Keno.

The cabinet 12 also provides controls for a player to operate gaming device 10. In the illustrated embodiment, various electromechanical input devices 18 are provided on a tilted portion 20 of the cabinet 12, below video monitors 14 and 16. Electromechanical input devices 18 each send a discrete signal to a microprocessor (described further below) located within cabinet 12. Those input devices enable the player to perform the various Keno functions, including but not limited to, selecting at least one of the Keno numbers, playing "ways" or multiple games at once, wagering a number of credits per game or "way" and cashing out. The input devices 18 also enable the player to play multiple Keno games in a row, analogous to the "multi-run" or "stray and play" Keno tickets offered by the casino.

Similar to the electromechanical input devices 18, cabinet 12 of gaming device 10 can provide electromechanical displays that show, for example, the player's credits maintained within gaming device 10, the number of Keno numbers played, the bet per game, etc. In one preferred embodiment, however, these functions as well as others are provided on one or more video monitor or display devices 14 and 16. In the illustrated embodiment, display device 14 shows the pays for a number of hits or matches between the numbers that the player selects and the numbers that gaming device 10 generates. Displays 14 array 16 can also inform the player of the rules concerning the operation of one or more or all of the embodiments of the present invention.

Video monitor 16 displays, without limitation: (i) the Keno numbers randomly generated by gaming device 10; (ii) the numbers played by the player; (iii) the number of "ways" or simultaneous games played by the player, and the numbers selected by the player for each "way", (iv) the wager per game; (v) the player's total wager; and (vi) the player's Keno or matching game award, if any. In one embodiment, when the player selects or picks a number or the game generates a number, gaming device 10 highlights it as a certain color, for example, yellow.

Cabinet 12 of gaming device 10 also includes one or more monetary input devices 22. The monetary input device 22 can accept coins, cash, a smart card, a credit card, a debit card, a casino card or other type of gaming device card. Keno gaming device 10 can also include a ticket reader and a ticket printer (not illustrated) that enables the player to input and receive a redeemable ticket in lieu of cash. The ticket reader/validator and printer operate with the processor housed inside gaming device 10.

Figure 2:
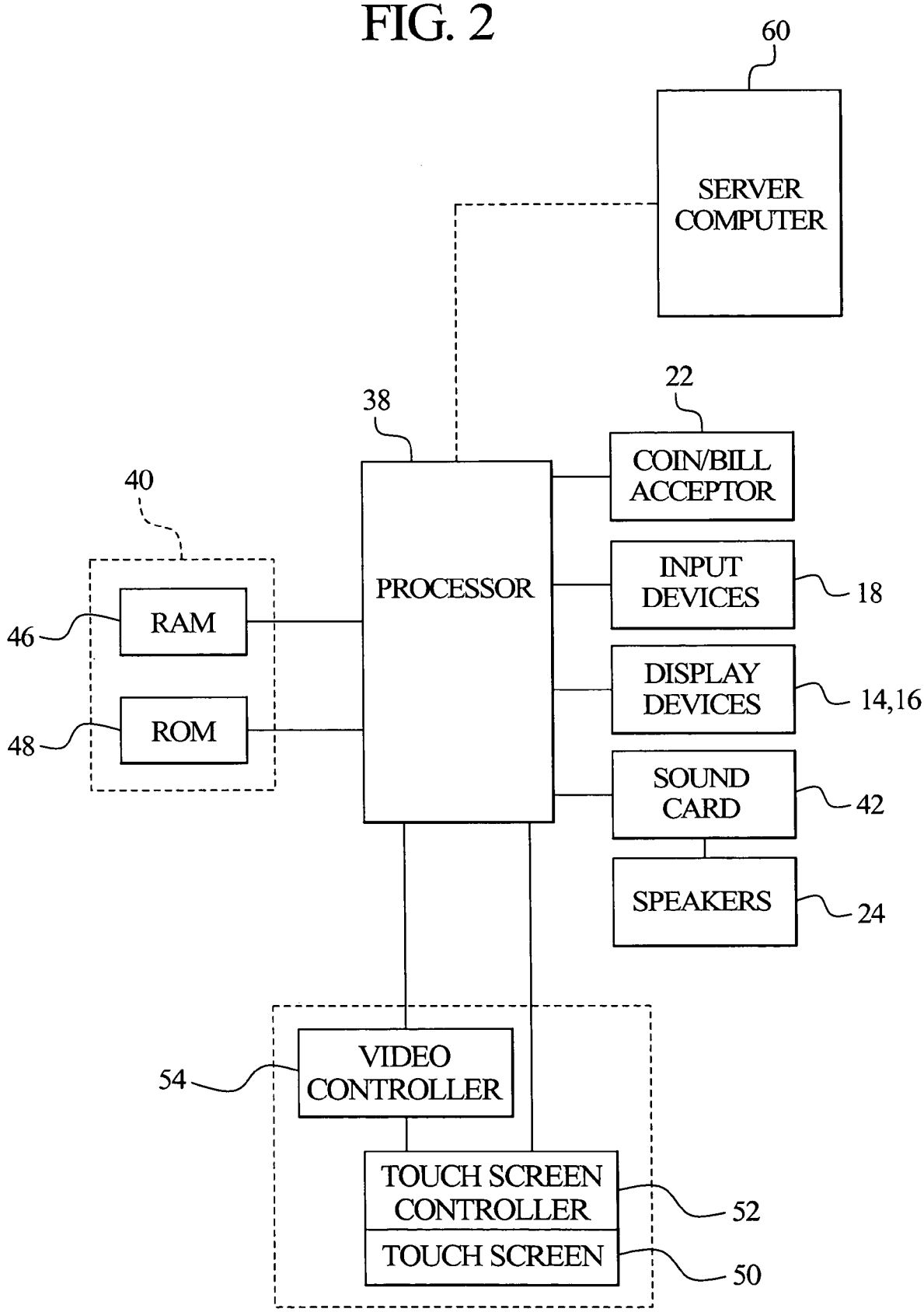
FIG. 2 is an electrical schematic for one embodiment of a gaming device having the Keno, Lotto, or Bingo game of the present invention.

Referring now to FIG. 2, gaming device 10 is run by a processor or central processing unit ("CPU") 38 and a memory device 40 that operates with one or more display devices 14 and 16 that display the generated Keno numbers. Processor 38 is in one embodiment a microprocessor and has a microcontroller-based platform. The memory device 40 includes random access memory ("RAM") 46 and read only memory ("ROM") 48. The platform for the processor 38 and memory device 40 is located variously: (i) inside gaming device 10; or (ii) as stand alone components in the casino, part of a server/client system, data network, one or more application-specific integrated circuits (ASIC's) or one or more hard-wired devices.

Gaming device 10 can house its own gaming program or be linked in a client/server manner via a data network to a server computer 60, wherein the present invention provides some or all of the functions of the processor and memory device at a central location, such as a network server for communication to a playing station over a local area network (LAN), wide area network (WAN), Internet connection, microwave link and the like.

Gaming device 10 provides one or more electromechanical input device 18 and/or simulated input devices. The simulated input devices are provided by a touch screen 50 that operates via a touch screen controller 52 and a video controller 54 with the processor 38. The input devices (mechanical or virtual) enable the player to operate the Keno gaming device 10 of the present invention. One of the video monitors 14 and 16 and possibly, additionally the speakers 24 are used to explain the operation of and perform the Keno games of the present invention. Cabinet 12 of gaming device 10 also provides a number of speakers 24 that operate via a soundcard 42 with processor 38 to inform the player of any type of output, outcome or audio instruction of gaming device 10.

Gaming device 10 in one embodiment operates the Keno game of the present invention as well as another game, such as slot, poker, blackjack, craps or other video wagering game. In one embodiment, the Keno game is displayed on one video monitor 14, while the second game is displayed on the second video monitor 16 or vice versa. Besides providing the Keno games of the present invention, any of the embodiments described herein can be coupled additionally with the one or more games, such as slot, poker, blackjack, craps, Bingo, etc. To that end, either monitor 14 or 16 may provide a menu or selections (or same may be electromechanical) that enables the player to choose to play a game from a plurality of different games such as Keno, Lotto, Bingo, slot, poker, blackjack, craps, etc. The Keno game pays out in tokens or coins in one embodiment but can additionally or alternatively payout non-monetary awards or bonus award, such as free games, a casino beverage or meal, a number of selections from a prize pool, etc.

The number matching game of the present invention, whether provided in gaming device 10 or as a casino game, can include any suitable variation of the game. For Keno, the game is illustrated in combination with the variation sometimes referred to as "horse race" or Nevada Keno. In that Keno game, one or more players play against the house. A typical Keno game includes eighty different numbers from which the player chooses. With gaming device 10, the player picks numbers via electromechanical input devices 18 or via touch screen 50. In the casino version, the player circles or marks one or more numbers on a casino card. The player decides which and how many numbers to select or pick, usually anywhere from one to fifteen numbers in casino play and one to ten numbers for play on gaming device 10.

As stated above, the Keno bonusing described below can be implemented alternatively as a live casino game. In the casino version, the player brings a marked card to a Keno clerk. The clerk records the player's numbers and issues a receipt to the player. The player finds a Keno monitor and watches the numbers being posted as they are chosen. As the player watches the generation of the Keno numbers, the player marks the generated numbers on the card. For an eighty number game of Keno, twenty numbers for example are generated.

Figure 3:
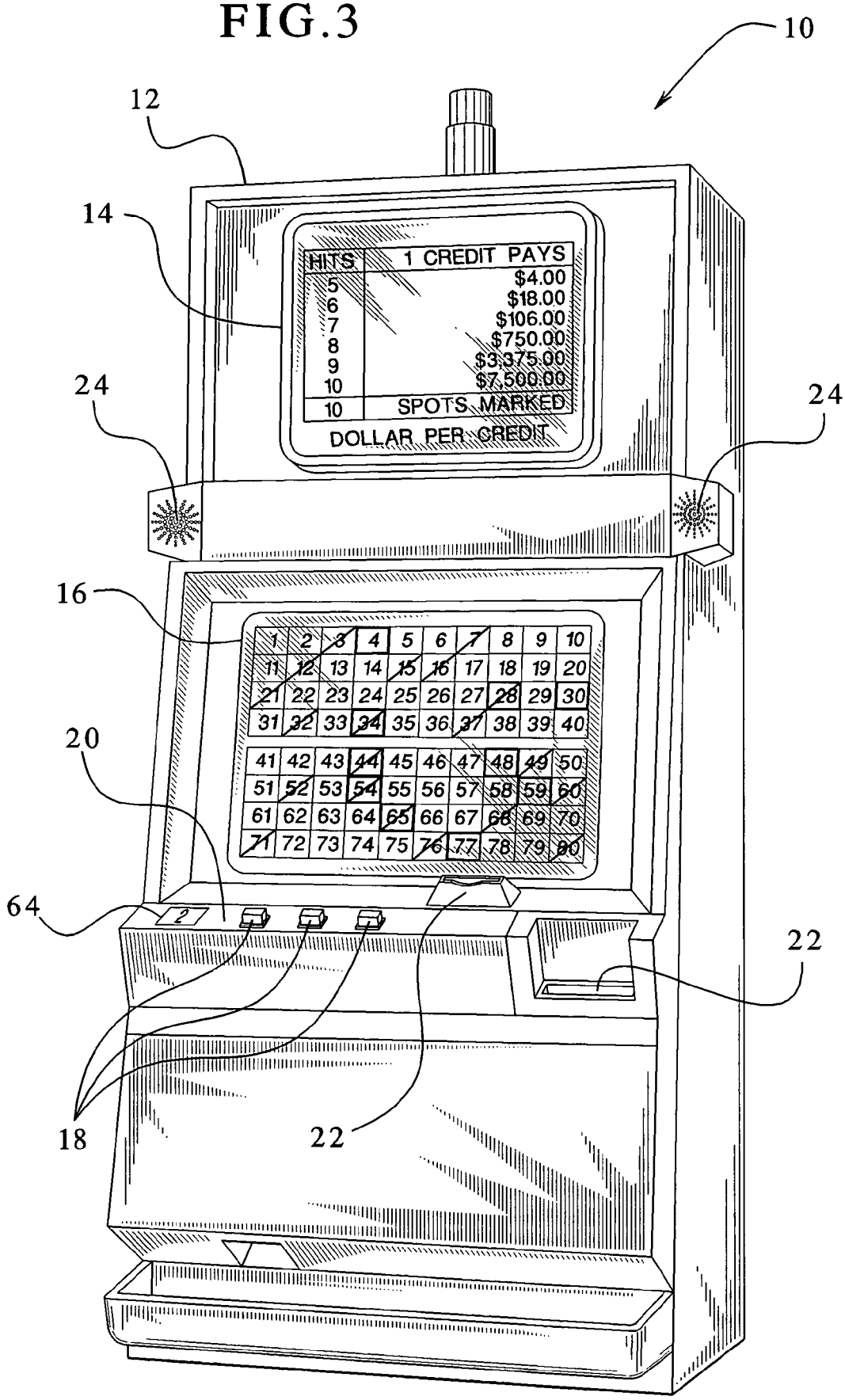
FIGS. 3 and 4 are perspective views of a gaming device having known Keno game displays.

FIGS. 1 and 3 illustrate an operation of a known Keno game. FIG. 1 illustrates a fresh screen on the second video monitor 16 with eighty numbers as they appear before the player has made any picks and before the game has shown any drawn numbers. FIG. 3 illustrates the same screen 16 with a completed Keno game. In this example, the player has pressed one of the electromechanical pushbuttons 18 or has touched the touch screen 50 that operates with display device 16 to select or pick ten numbers 4, 28, 30, 34, 44, 48, 54, 59, 65 and 77. Alternatively, the player presses an input that autopicks numbers for the player. The term "player's picks" and "selected player picks" expressly include the player's selection of individual numbers as well the generation of picks for the player via the autopicks function. The player's picks are shown in FIG. 3 as bolded and bordered. In the example illustrated, gaming device 10 has randomly generated or drawn twenty numbers 3, 7, 12, 15, 16, 21, 28, 32, 34, 37, 44, 49, 52, 54, 60, 65, 68, 71, 76 and 80. The drawn numbers have a slash-through.

There are five matches shown in FIG. 3, namely, numbers 28, 34, 44, 54 and 65 (bearing both markings). According to the paytable displayed in display device 14, gaming device 10 pays $4.00 on a one dollar bet for five matches or hits, in this case for ten player picks. A two dollar bet would pay $8.00 for five matches, a three dollar bet would pay $12.00, etc. Keno payouts can vary. For example, if the player picks five numbers, the Keno game can require that the random generation device draw two of those five numbers for the player to receive any award or three of those five numbers for the player to receive any award. If the Keno game draws for example three matches, the Keno game can pay the player back at three to one, 2.5 to one, 3.5 to one, etc.

The number of matches determines the player's award independent of which numbers are matched. The award, if any, depends on the percentage or amount of the player's picks that are also generated randomly by gaming device 10 or the house. In FIG. 1, for example, the player starts with three credits as seen in credit meter 64. The game costs one dollar to play. FIG. 3 illustrates that the player has played one game, decreasing the player's credits to two as seen in credit meter 64.

Figure 4:
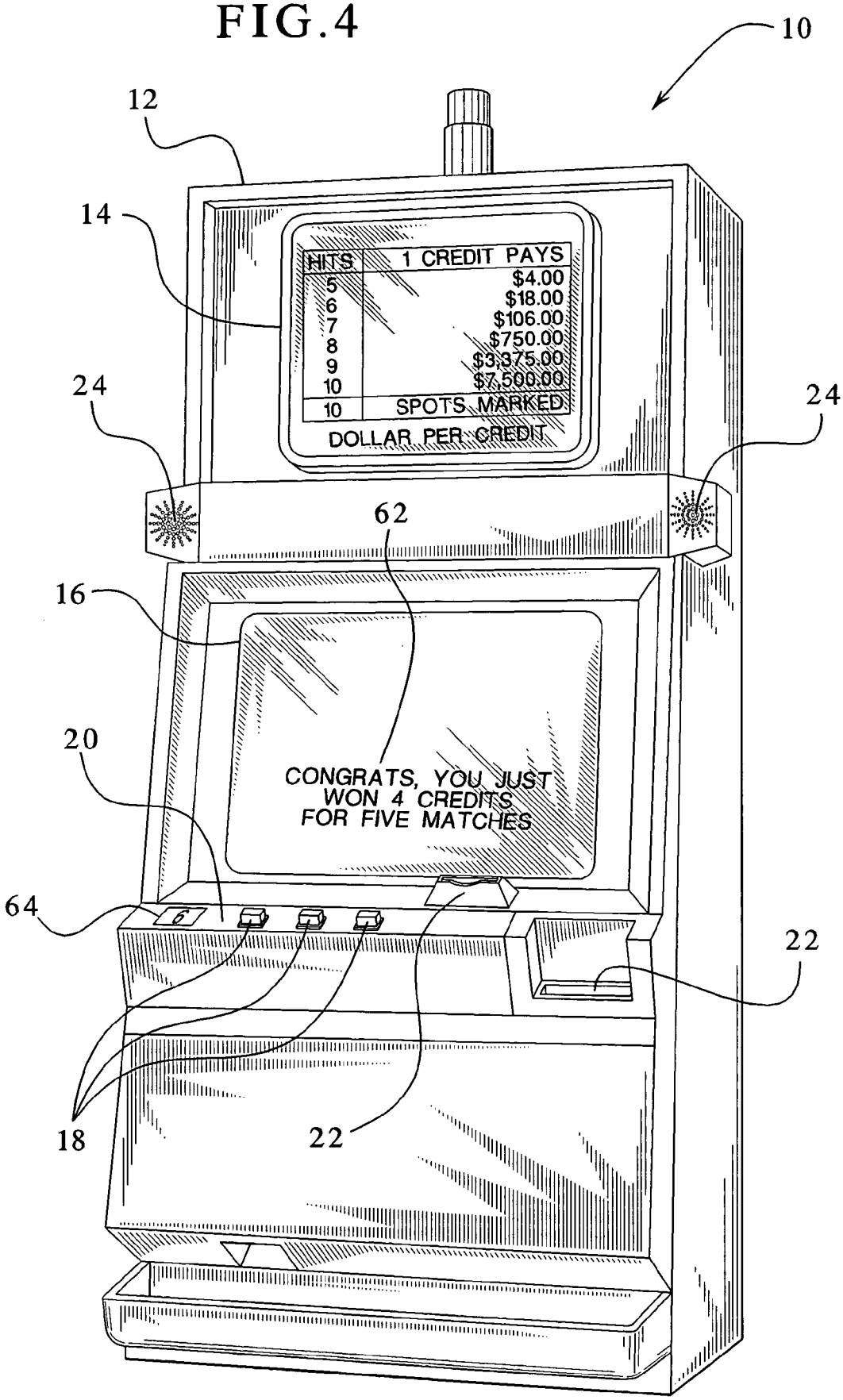

FIG. 4 illustrates via message 62 and credit meter 64 that gaming device 10 in known Keno has paid the player four credits for obtaining five matches, increasing the total to six. In casino play, if the player has enough matches to claim a winning ticket, which depends on how many numbers the player has selected, the player returns to the Keno clerk to redeem the winning ticket.

Figure 5:
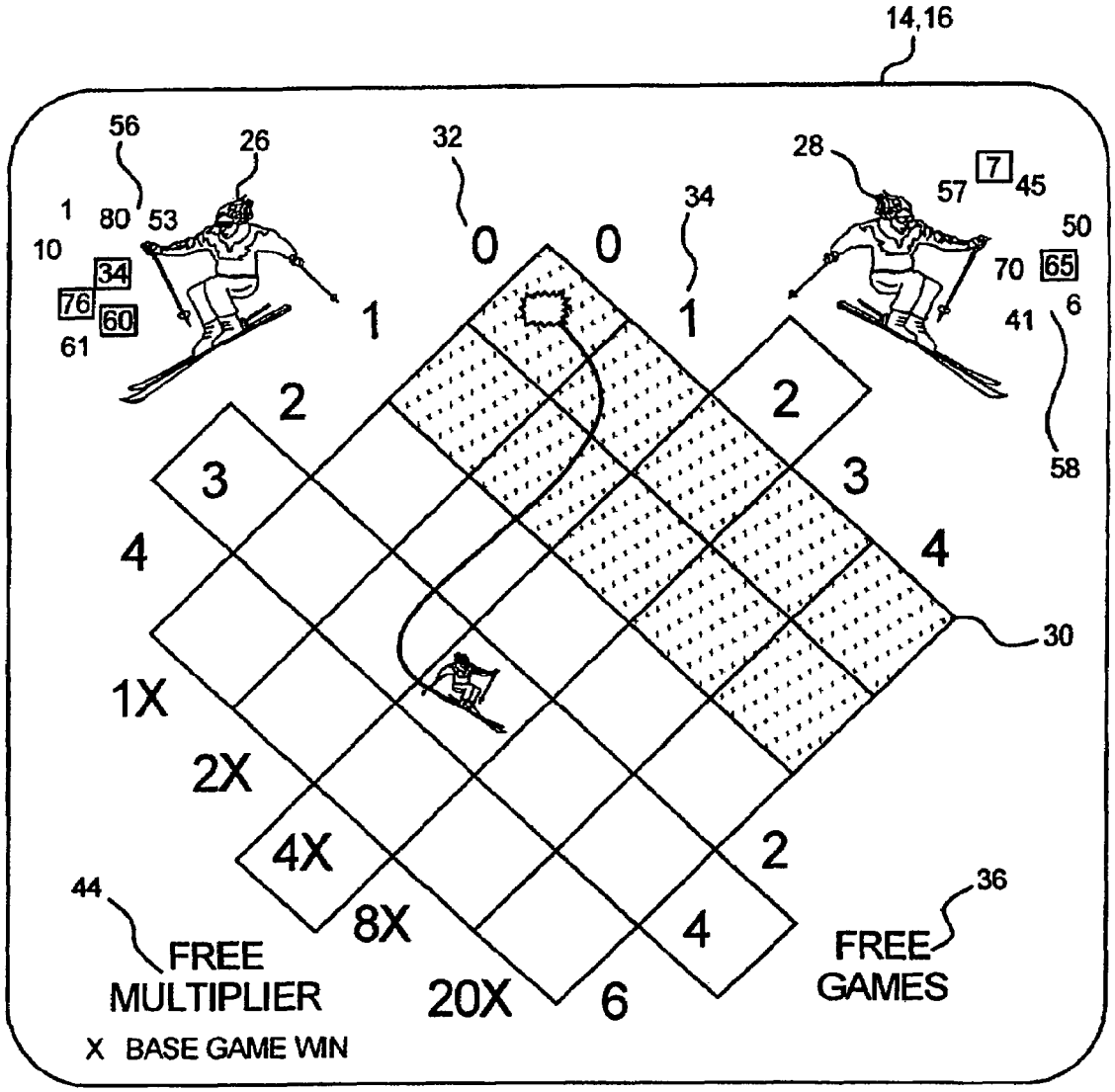
FIG. 5 is a front elevation view of a display device displaying one embodiment of the matching type bonus game of the present invention.

Referring now to FIG. 5, one embodiment for the matching type bonus game of the present invention is illustrated. It should be appreciated that while the bonus game described below is readily implemented in connection with a Keno, Lotto, Bingo or other matching-type base game, the bonus game is compatible with any suitable base game, such as slot, blackjack, craps, poker, bunco, checkers and the like.

The embodiment illustrated in FIG. 5 includes two skiers including a left facing skier 26 and a right facing skier 28. Skiers 26 and 28 each represent a different type of bonus award. A skier is also displayed on a grid or two dimensional array 30 moving a distance along axes 32 and 34 corresponding to a number of matches occurring in association with left facing skier 26 and a number of matches associated with right facing skier 28.

Left facing skier 26 is associated with a first type of bonus game award, e.g., the provision of an amount of free games 36. Right facing skier 28 is associated with a second type of bonus game award, e.g., a multiplier 44. In the illustrated embodiment, the multiplier multiplies a win in the base game. The base game win as described above with Keno, is a payout according to the paytable in FIGS. 1, 3 and 4. The payout is based on a number of matches and a multiplication of the number of the credits wagered by the player on the game. The bonus multiplier multiplies the base game payout. Other suitable types of bonus game awards are described below in connection with FIG. 8.

Left facing skier 26 is associated with a set of symbols such as a plurality of first skier symbols or numbers 56. Right facing skier 28 is associated with a set of symbols, such as plurality of second skier symbols or numbers 58.

In the illustrated embodiment, bonus numbers of sets 56 and 58 are compared with the numbers generated randomly by gaming device 10 in the base game. That is, gaming device 10 generates one time a set of base game numbers, e.g., twenty numbers from the overall numbers one to eighty. That set of randomly generated numbers is used in the base matching game to compare against the player selected base Keno numbers. The original generation of twenty numbers is also used in the bonus game of FIG. 5 to compare with bonus numbers of set 56 associated with left facing skier 26 and bonus numbers of set 58 associated with right facing skier 28. As seen in FIG. 3, the original twenty numbers of the numbers one through eighty generated by a random generation device within gaming device 10 are the numbers: 3, 7, 12, 15, 16, 21, 28, 32, 34, 37, 44, 49, 52, 54, 60, 65, 68, 71, 76 and 80.

Comparing the above-listed randomly generated numbers to bonus numbers of set 56 associated with left facing skier 26, namely, the numbers: 1, 10, 34, 53, 60, 61, 76 and 80, it should be appreciated that left facing skier 26 generates three matches. Comparing the above randomly generated numbers with bonus numbers of set 58 associated with right facing skier 28, namely, numbers: 6, 7, 41, 45, 50, 57, 65 and 70, right facing skier 28 generates two matches. In particular, left facing skier 26 generates matches for numbers 34, 60 and 76, while right facing skier 28 generates matches for the numbers 7 and 65.

Display 30 is a grid or two by two array that is rotated forty-five degrees from a position where the grid lines would be horizontal and vertical. Alternatively, the two by two array is shown in a square or rectangular format or in any suitable arrangement. The rotation of the grid aids in providing a moving pictorial display of a skier who moves an amount corresponding to the number of matches for the left facing skier 26 and the number of matches for the right facing skier 28. If neither skier obtains any matches, the skier on grid 30 does not move at all and stays in the grid area corresponding to zero matches by zero matches. If right facing skier 28 obtains one match and left facing skier obtains zero matches, the skier on grid 30 moves only one grid area at an angle of approximately three hundred fifteen degrees from an imaginary horizontal line through the skier positioned in grid area zero, zero along axes 32 and 34.

As illustrated, because left facing skier 26 obtained three matches, the skier on grid 30 changes direction to move from the imaginary horizontal line to a position on the grid of 3, 1 along axes 32 and 34. Further, because right facing skier obtains two matches, skier 30 again changes direction and moves to a final position of 3, 2 along axes 32, 34, respectively. In the above-described manner, display 30 provides a fun and exciting representation of a multi-bonus or two by two matching bonus game outcome.

It should be appreciated that for a combination of three matches for left facing skier 26 and two matches for right facing skier 28, the overall path taken by the skier on display 30 can vary. For instance, the skier on path 30 can move three positions along axis 32 and then two positions along axis 34. Alternatively, the skier can move two positions along axis 34 and then three positions along axis 32. The skier on grid 30 could move one position along axis 32, one position along axis 34, then one position along axis 32, another position along axis 34, and then a final position along axis 32. It should be appreciated that other combinations are possible.

Axes 32 and 34 designate each a number of matches and a bonus award type. As illustrated, axis 32 also corresponds with a number of free games 36. Axis 34 also corresponds with a multiplier 44. In both instances, the corresponding bonus game requires a threshold number of matches before the player receives a bonus award. For instance, no free games 36 are provided if left facing skier 26 obtains no matches or only a single match (see hatched "no free game zone" in FIG. 5). A 1× multiplier or, in essence, no multiplier is provided if right facing skier 28 does not obtain a match. The bonus payouts can begin at any threshold amount and increment in any desired fashion within the boundaries of the game mathematics.

In the illustrated embodiment, the free games 36 start at two free games after two left facing skier 26 matches and increment for each succeeding left facing skier 26 match by two additional free games. The multipliers increment non-linearly beginning at a multiplier of 2×, increasing to 4×, increasing to 8× then 20×. The multipliers and free games 36 can begin at any combination of matches, including zero matches by zero matches. The initial number of free games or the amount of the multiplier can be any number or amount as desired. Further, the free games 36 and multiplier 44 can increment as desired by the game implementor.

As discussed below in connection with FIG. 8, the bonus award types in one embodiment are interactive. The free games 36 and multiplier 44, for instance, are interactive in one embodiment. In one embodiment, the multiplier 44 multiplies a base game win occurring in one of the free games 36, but not in the initial primary game. In that manner, if the player obtains the 20× multiplier but obtains no free games, the multiplier has nothing to multiply. In the illustrated embodiment, therefore, the left facing skier 26 has to obtain at least two matches for the player to achieve any bonus payout. In an alternative embodiment, the multiplier could also or alternatively multiply a base game win occurring in the current or initiating base game.

Referring now to FIGS. 6 to 8, tables highlighting many different types of alternative embodiments for the bonus matching game of the present invention are illustrated. The tables are not meant to be exhaustive or completely inclusive of all embodiments of the present invention. Instead, the tables highlight that the wagering game of the present invention is highly flexible and conducive to multiple implementations and alternatives.

FIG. 6 illustrates a table 70 that highlights multiple different example embodiments of the present invention for sequencing or choreographing the bonus display with the base game matching display. The base game Keno, Bingo or Lotto match game occurs in a same overall game play as the bonus game shown above in connection with FIG. 5. FIGS. 1, 3 and 4 illustrate one embodiment of a base game play, namely, that of a Keno game. FIG. 6 lists where and when the bonus game is played with respect to play of the base matching game.

As highlighted by sequence 72, in one embodiment, the bonus or skier display is displayed on a separate display device simultaneously or substantially simultaneously with the base game sequence display. For example, the base game display is displayed in one embodiment on display device 16, while the bonus display is displayed on display device 14 shown in FIGS. 1, 3 and 4. In sequence 72, the base game matches and the bonus game matches for both skiers 26 an 28 are displayed simultaneously or substantially simultaneously with the game's draw of the twenty numbers shown in FIG. 3.

In an alternative embodiment, the bonus display is displayed on a separate display device after the base sequence display, as illustrated by overall sequence 74. In sequence 74, the base game display of FIGS. 1, 3 and 4 is made on a first display device, such as lower display device 16. Afterward, the bonus display shown in FIG. 5 is displayed on a separate display device, such as upper display device 14.

In sequence 76, the base and bonus displays are displayed simultaneously or substantially simultaneously on the same display device. For example, a portion of large display device 16 shown in FIGS. 1, 3 and 4 is dedicated to the base game draw and player number match, while the bonus or ski display is displayed at the same time in a different part of display device 16.

Another alternative display sequence is illustrated by sequence 78. Here, the bonus or ski display is displayed on the same display device as the base game display. The bonus display occurs after the base game display. In that manner, the entire display device, such as display device 16, can be dedicated to each display. The bonus display in essence replaces the base game display. The randomly drawn numbers in FIG. 3, in one embodiment, are moved to the top, bottom or side edges of display device 16 and maintained throughout the bonus display. Those numbers in one embodiment are also used in the bonus display for the multiple bonus award evaluations. As discussed earlier, however, in one embodiment, gaming device 10 randomly generates a new set of numbers for the bonus game evaluations.

In a further alternative embodiment highlighted by sequence 80, the bonus display occurs regardless of the base game outcome. For example, when the free multiplier bonus 44 is used to multiply a base game win in a subsequent free or additional game, the bonus award is not dependent upon an outcome in the instant base game play. The present invention, therefore, expressly contemplates providing a bonus award to the player regardless of the player's success in the base game.

In an alternative embodiment, illustrated by sequence 82, the bonus game sequence is displayed only upon a win or threshold outcome in the triggering base game. The threshold can include a particular level of win or a threshold amount of base game matches. For example, gaming device 10 in one embodiment requires at least one match in the base game to trigger the bonus game or ski sequence even though a single match in many cases, e.g., upon the player's pick of ten symbols, does not yield a base game payout to the player. Alternatively, for a ten spot game, gaming device 10 in one embodiment requires at least six matches, or a base game award of at least sixteen credits as a threshold to provide the bonus display.

Any combination of the alternative sequences 80 and 82 may be employed with alternative sequences 72, 74, 76 and 78. Again, sequences 72 to 82 do not provide an exhaustive list of sequences. Further, the present invention includes having no eligibility or trigger requirements, (ii) requiring a certain threshold or certain outcome in the base game to trigger bonus play, (iii) requiring a threshold wager or wager component to trigger bonus play or (iv) any suitable combination thereof.

Referring now to FIG. 7, table 90 lists various alternatives for establishing the bonus numbers or symbols of sets 56 and 58 used in the bonus game. As illustrated by alternative 92, in one embodiment, the player's numbers in the bonus game are the same numbers used in the base game. The numbers are used for both bonus awards 36 and 44. That is, if the player makes eight picks on the base game, the eight picks are used in connection with left facing skier 26 (award type 36) as well as right facing skier 28 (award type 44). Player numbers 56 and 58 in FIG. 5 would contain the same eight symbols or numbers.

As illustrated in alternative embodiment 94, gaming device 10 uses the player's numbers in the base game, and splits the same numbers among both bonus award types. In this embodiment, each skier 26 and 28 is associated with a separate and exclusive set 56 and 58 of symbols or numbers, respectively. If the player selects an odd overall amount of numbers in the base game, one of the sets of bonus numbers 56 and 58 has an extra symbol or number. Each skier 26, 28 is associated in one embodiment with roughly half of the total amount of player's numbers picked for in the base game.

Referring now to alternative embodiment 96, the player in one alternative embodiment is enabled to independently pick a separate set of numbers for both bonus award types. That is, the player can pick an amount of numbers to associate with skier 26 and the corresponding free games award type 36. The player picks another set of numbers to associate with right facing skier 28 and corresponding multiplier award type 44. In one embodiment, the player has to pick different numbers to associate with each bonus type. Further, the player may or may not be able to pick a same number picked for the base matching game. Alternatively, the player can select one or more numbers to associate with both left facing skier 26 and right facing skier 28, i.e., with free games 36 and multiplier 44, respectively. In one embodiment, the player can select different amounts of numbers for the different bonus types 36 and 44. Alternatively, the player has to pick the same amount of numbers for both. In one embodiment, the total amount of numbers that the player can select is predetermined and does not vary. For example, grid 30 shows a possibility of four matches. Gaming device 10 in one embodiment requires the player to pick four numbers for each bonus type. In an alternative embodiment, the player can pay for one or more additional picks if desired. Each additional pick may cost the same amount or different amounts such as increasing amounts.

As illustrated by alternative embodiment 98, some or all of the player's base game picks are used for one of the bonus award types, while the player selects new numbers for the other of the bonus award types. For example, some or all of the player's base game picks can be associated with the free games award type 36, while the player picks new numbers for the multiplier 44, or vice versa.

As illustrated by alternative 100, gaming device 10 in one preferred embodiment independently randomly picks the bonus symbols or numbers for both bonus award types 36 and 44. As before, gaming device 10 can be able to or not be able to randomly select or not select one or more of the same numbers for both of the award types 36 and 44. Further alternatively, gaming device 10 may or may not be able to randomly generate a different amount of numbers for award types 36 and 44. Still further alternatively, gaming device 10 may or may not be able to generate a symbol or number picked by the player for the base matching game.

As indicated by alternative embodiment 102, gaming device 10 in a further alternative embodiment generates some of the bonus numbers, while the player picks other of the bonus numbers. The numbers are distributed as desired. For example, the player picked bonus numbers can be assigned to one bonus award type, while the game's randomly generated bonus numbers are assigned to another bonus award type. In a further alternative embodiment, the numbers are mixed.

As illustrated by alternative embodiment 104, in a further alternative embodiment, the bonus numbers for both award types are fixed. The numbers can be fixed: (i) for each and every year or play; (ii) for a designated number of game plays; (iii) for a period of time; (iv) until the player switches the numbers; (v) until an operator switches the numbers; or (vi) until gaming device 10 randomly switches the numbers.

As illustrated by alternative embodiment 106, in a further alternative embodiment, the player picks some of the bonus numbers, while other bonus numbers are fixed. The periods for which the fixed numbers are fixed can vary according to each of the embodiments illustrated with alternative embodiment 104. The player picked versus fixed bonus numbers can be distributed as described above in connection with alternative embodiment 102.

In another alternative embodiment illustrated by embodiment 108, gaming device 10 randomly generates certain bonus numbers, while other bonus numbers are fixed. The period for which the numbers are fixed can be any period set forth in connection with alternative embodiment 104. The randomly generated bonus numbers and the fixed bonus numbers can be distributed according to the varying bonus award types 36 and 44 in any of the ways described above in connection with alternative embodiment 102.

Referring now to FIG. 8, a table 110 illustrates various possible bonus award types. The list in table 110 is not exhaustive or completely inclusive and merely illustrates that the present invention is conducive to operating with many different types of bonus awards. In general, the overall benefit provided to the player can include any benefit that can be split into two dimensions, e.g., an overall value that can be split into a value multiplied by a multiplier. The award types can then be capable of any two or more parameters forming the overall benefit.

As eluded to earlier, the bonus award types can be interactive 112 or non-interactive 114. An interactive pair of bonus award types is one where one bonus award type is dependent upon another. For example, when the free multipliers 44 are used to multiply wins in free games 36, the multipliers 44 are dependent upon the occurrence of a free game 36. If a free game does not occur, the other dependent or interactive bonus award type does not apply. A non-interactive pair of bonus award types could be, for example, a number of credits provided in the instant game and a number of free games.

Alternative embodiments 116 and 118 reiterate that the bonus award types include free games, such as free games 36 shown in FIG. 5 and a multiplier, such as multiplier 44 shown in FIG. 5. The multiplier 118 can multiply any suitable number of credits, such as a win, a wager or a component of the player's wager. In embodiment 120, the bonus award type is a number of credits provided to the player in the triggering game or a free game, for example.

As indicated by alternative embodiment 122, the bonus award type can be in the form of a hand pay. As indicated by alternative embodiment 124, the bonus award can be paid on a ticket. Further alternatively, as indicated by alternative embodiment 126, the award type is alternatively non-monetary, such as a product or service offered by the casino, gaming establishment or elsewhere.

Figure 9:
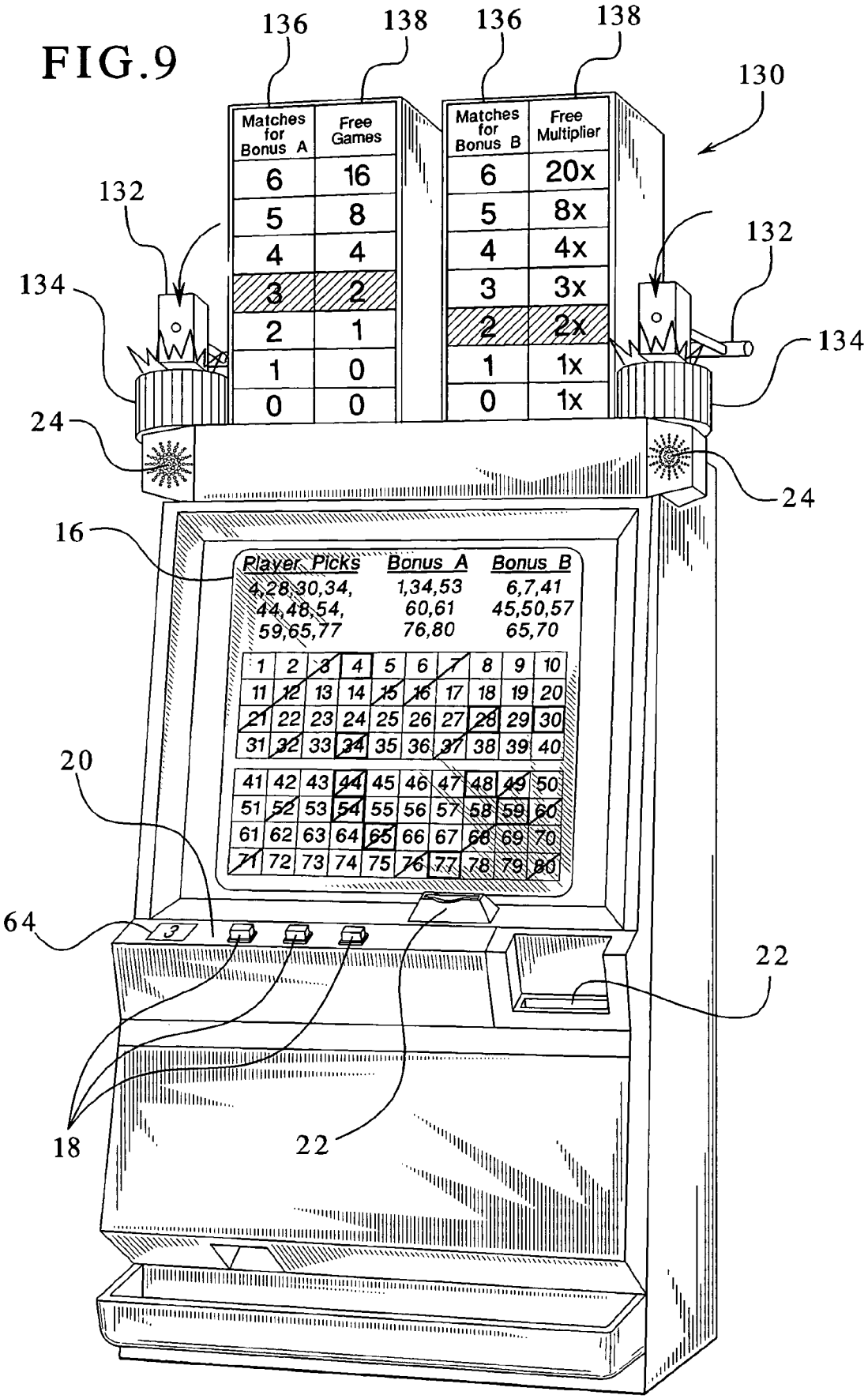
FIG. 9 is a perspective view of a gaming device having an alternative electromechanical bonus display and a single bonus award type.

Referring now to FIG. 9, alternative gaming device 130 illustrates a number of additional features and alternative embodiments of the present invention. First, the bonus award types are not limited to being displayed as a skier, but alternatively include any type of video or audiovisual sequence in which any type of character, object or other indicator moves to, is relocated at, or is positioned on the screen to represent a number of matches. Besides a physical movement of the object, the present invention also includes the incrementing of a meter via a change in indicia, color or lighting. Alternatively or additionally, the present invention includes a sound change, such as a volume change, pitch change or change in frequency that signals an advancement in terms of the number of matches between the player's numbers and the game's randomly drawn numbers.

Gaming device 130 also illustrates that an electromechanical or purely mechanical display device can alternatively be employed instead of a video device to illustrate an incrementing of a number of matches. Gaming device 130 includes a rotating lever arm 132, which in the illustrated embodiment is made in the shape of a sledge hammer used at a carnival to hit a block of wood 134 or other suitable item. Towers or columns 136 illustrate a number of bonus matches ascending from zero to six for bonus A and bonus B. A corresponding number of free games is illustrated as incrementing from zero to sixteen in a column or tower 138 for bonus A, a corresponding number. The hammers 132 are moved to engage blocks 134 to correspond to a generation of numbers which occurs for example on display device 16. Based on that generation of numbers and the bonus numbers for the bonus game, the number of matches increments accordingly and the player is provided the appropriate award value. It should thus be appreciated that the display could be varied and the generation of symbols such as numbers do not have to be random or fully random.

The present invention contemplates that in an alternative embodiment the inclusion of a single award type and a one-dimensional award display. For example, in an alternative electromechanical or mechanical embodiment, only one set of apparatus 132 to 138 is provided, e.g., one for free games or for a multiplier, etc. Further, as discussed above, the present invention includes providing and indicating three or more different award types using a three dimensional display, e.g., on a simulated or electromechanical display device.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

at least one display device;

at least one input device; and at least one processor programmed to operate with said at least one display device and said at least input device for a play of a game to:

(a) display a base game operable upon a wager, said base game including a set of symbols, said set of symbols including a plurality of symbols;

(b) enable a player to select a first subset of symbols from the set of symbols, said first subset of symbols including at least one of the symbols of the set of symbols;

(c) display a second subset of symbols from the set of symbols, said second subset of symbols including at least one of the symbols of the set of symbols;

(d) determine if the player is entitled to a base award, said base award based at least in part on how many symbols from the first subset of symbols match symbols from the second subset of symbols;

(e) display a third subset of symbols from the set of symbols and a fourth subset of symbols from the set of symbols;

(f) determine if the player is entitled to a first number of free plays of the base game based on whether a first number of symbols from the second subset of symbols match symbols from the third subset of symbols;

(g) determine if the player is entitled to a second different number of free plays of the base name based on whether a second different number of symbols from the second subset of symbols match symbols from the third subset of symbols;

(h) determine how many symbols from the second subset of symbols match symbols from the fourth subset of symbols;

(i) if the player is entitled to the first number or second number of free plays of the base game, display the free games and determine and display an award value for each free play of the base game based at least in part on a benefit based on the determination of how many symbols from the second subset of symbols match symbols from the fourth subset of symbols; and (j) if the player is entitled to the award value for each free play of the base game, display the award value.

2. The gaming device of claim 1, wherein the benefit is a multiplier that multiplies an amount of credits associated with each free play of the base game, the multiplier determined based on how many symbols from the second subset of symbols match symbols from the fourth subset of symbols.

3. The gaming device of claim 1, wherein the base award includes a paytable payout based on how many symbols from the first subset match symbols from the second subset multiplied by a number of credits wagered.

4. The gaming device of claim 1, wherein the third subset of symbols has a characteristic selected from the group consisting of: being static; being static for a period of time; being randomly generated prior to the random generation of the second subset of symbols; being player selected prior to the random generation of the second subset of symbols; being displayed to the player prior to the random generation of the second subset of symbols; having at least partially the same symbols as the first subset of symbols; having at least partially the same symbols as the fourth subset of symbols; and any combination thereof.

5. The gaming device of claim 1, wherein the fourth subset of symbols has a characteristic selected from the group consisting of: being static; being static for a period of time; being randomly generated prior to the random generation of the second subset of symbols; being player selected prior to the random generation of the second subset of symbols; being displayed to the player prior to the random generation of the second subset of symbols; having at least partially the same symbols as the first subset of symbols; having at least partially the same symbols as the third subset of symbols; and any combination thereof.

6. The gaming device of claim 1, wherein the symbols include numbers.

7. The gaming device of claim 1, wherein said at least one display device and said at least one input device are supported by a housing.

8. The gaming device of claim 7, wherein said at least one processor is remote from said housing.

9. The gaming device of claim 1, wherein the at least one display device displays a visual movement indicating at least one of: (i) how many symbols from the third subset of symbols match symbols from the second subset of symbols; and (ii) how many symbols from the fourth subset of symbols match symbols from the second subset of symbols.

10. The gaming device of claim 9, wherein the visual movement is displayed on a first display device separate from a second display device that displays the generation of the second subset of symbols.

11. The gaming device of claim 9, wherein the visual movement is displayed on a same display that displays the generation of the second subset of symbols.

12. The gaming device of claim 9, wherein the visual movement is displayed after and in lieu of a display of the generation of the second subset of symbols.

13. The gaming device of claim 9, wherein the visual movement is displayed substantially simultaneously with a display of the generation of the second subset of symbols.

14. The gaming device of claim 1, wherein the at least one display device displays a visual movement in a first direction indicating how many symbols from the third subset of symbols match symbols from the second subset of symbols and in a second direction indicating how many symbols from the fourth subset of symbols match symbols from the second subset of symbols.

15. The gaming device of claim 13, wherein the first and second directions are substantially perpendicular to each other.

16. A method of operating a gaming device including at least one input device, at least one display device and at least one processor programmed to operate with said at least one display device and said at least input device for a play of a game, said method comprising:

enabling a player to select a subset of symbols from a set of symbols using the at least one input device;

causing the at least one processor to:

designate a first bonus subset of symbols from the set of symbols;

designate a second bonus subset of symbols from the set of symbols; and randomly generate a subset of symbols from the set of symbols; and causing the at least one display device to display a base award, said base award based at least in part on how many of the player selected and randomly generated symbols match, and after causing the at least one display device to display the base award:

displaying a first type of bonus award based on how many of the symbols from the first bonus subset of symbols and randomly generated symbols match in the at least one display device, wherein the first type of bonus award is a number of free plays of the game; and displaying a second type of bonus award based on how many of the symbols from the second bonus subset of symbols and randomly generated symbols match in the at least one display device, wherein the second type of bonus award is a multiplier which is applied to any award resulting from each free play of the game.

17. The method of claim 16, wherein causing the at least one processor to designate the first and second bonus subsets of the symbols includes an action selected from the group consisting of: (i) causing the at least one processor to designate the subsets for all time; (ii) causing the at least one processor to designate the subsets for a number of game plays; (iii) enabling the player to pick the subsets using the at least one input device; (iv) causing the at least one processor to generate the subsets randomly; (v) causing the at least one processor to enable at least some of the symbols in the first and second subsets to be shared; (vi) causing the at least processor to use at least some of the symbols from the player selected symbols as symbols in one of the first and second bonus subsets of symbols; and (vii) any combination thereof.

18. The method of claim 16, which includes causing the at least one display device to display visual content selected from the group consisting of: (i) the selections of the player subset; (ii) the designation of the first and second bonus subsets; (iii) the randomly generated subset; (iv) an indication of how many of the player selected symbols match the randomly generated symbols; (v) an indication of how many of the first bonus subset symbols match the randomly generated symbols; (vi) the award provided; (vii) the first type of bonus award provided; (viii) the second type of bonus award provided; and (ix) any combination thereof.

19. The method of claim 16, which operates through a data network.

20. The method of claim 19, wherein the data network is an internet.

21. A gaming device comprising:

at least one display device;

at least one input device; and at least one processor programmed to operate with said at least one display device and said at least one input device for a play of a game to:

(a) display a set of symbols;

(b) enable a player to select a first subset of symbols from the set of symbols;

(c) randomly generate and display a second subset of symbols from the set of symbols;

(d) determine if the player is entitled to a base award, said base award at least in part based on how many symbols from the first subset of symbols match symbols from the second subset of symbols;

(e) display any determined base award; and (f) after displaying any determined base award:

(i) display a third subset of symbols from the set of symbols;

(ii) display a fourth subset of symbols from the set of symbols;

(iii) display a first type of bonus award based on how many symbols from the second subset of symbols match symbols from the third subset of symbols, wherein the first type of bonus award is a number of free plays of the game; and (iv) display a second type of bonus award based on how many symbols from the second subset of symbols match symbols from the fourth subset of symbols, wherein the second type of bonus award is a benefit that occurs in connection with at least one of the free plays of the game.

22. The gaming device of claim 21, wherein the benefit is a multiplier.

23. The gaming device of claim 21, wherein the third subset of symbols has a characteristic selected from the group consisting of: being static; being static for a period of time; being randomly generated prior to the random generation of the second subset of symbols; being player selected prior to the random generation of the second subset of symbols; and being displayed to the player prior to the random generation of the second subset of symbols.

24. The gaming device of claim 21, wherein the fourth subset of symbols has a characteristic selected from the group consisting of: being static; being static for a period of time; being randomly generated prior to the random generation of the second subset of symbols; being player selected prior to the random generation of the second subset of symbols; and being displayed to the player prior to the random generation of the second subset of symbols.

25. A method of operating a gaming device including at least one input device, at least one display device and at least one processor programmed to operate with the at least one input device and the at least one display device for a play of a base game, the method comprising:

causing the at least one display device to display a set of symbols;

enabling a player to select a first subset of symbols from the set of symbols using the at least one input device;

causing the at least one processor to randomly generate and cause the at least one display device to display a second subset of symbols from the set of symbols;

causing the at least one processor to determine if the player is entitled to a base award, said base award at least in part based on how many symbols from the first subset of symbols match symbols from the second subset of symbols; and causing the at least one display device to display any determined base award, and after displaying any determined base award:

displaying a third subset of symbols from the set of symbols;

displaying a fourth subset of symbols from the set of symbols;

displaying a first type of bonus award based on how many symbols from the second subset of symbols match symbols from the third subset of symbols, wherein the first type of bonus award is a number of free plays of the base game; and displaying a second type of bonus award based on how many symbols from the second subset of symbols match symbols from the fourth subset of symbols, wherein the second type of bonus award is a benefit that occurs in connection with at least one of the free plays of the base game.

26. The gaming device of claim 25, wherein the benefit is a multiplier.

27. The method of claim 25, which is operated through a data network.

28. The method of claim 27, wherein the data network is an internet.

29. A method of operating a gaming device including at least one input device, at least one display device and at least one processor programmed to operate with the at least one input device and the at least one display device for a play of a game, the method including:

causing the at least one display device to display a base game operable upon a wager, said base game including a set of symbols, said set of symbols including a plurality of symbols;

enabling a player to select a first subset of symbols from the set of symbols using said at least one input device, said first subset including at least one of the symbols of the set of symbols;

causing the at least one display device to displaying a second subset of symbols from the set of symbols, said second subset including at least one of the symbols of the set of symbols;

causing the at least one processor to determine if the player is entitled to a base award, said base award based at least in part on how many symbols from the first subset match symbols from the second subset;

causing the at least one display device to display a third subset of symbols from the set of symbols and a fourth subset of symbols from the set of symbols; and causing the at least one processor to:

determine if the player is entitled to a first number of free plays of the base game based on whether a first number of symbols from the second subset of symbols match symbols from the third subset of symbols;

determine if the player is entitled to a second different number of free plays of the base name based on whether a second different number of symbols from the second subset of symbols match symbols from the third subset of symbols;

determine how many symbols from the second subset of symbols match symbols from the fourth subset of symbols;

if the player is provided the first number or second number of free plays of the base game, determine an award value for each free play of the base game based at least in part on a benefit based on the determination of how many symbols from the second subset of symbols match symbols from the fourth subset of symbols; and if the player is entitled to the award value for each free play of the base game, display the award value on the at least one display device.

30. The method of claim 29, which is provided through a data network.

31. The method of claim 30, wherein the data network is an internet.

* * * * *